US007025471B2

(12) United States Patent
Gorrie et al.

(10) Patent No.: US 7,025,471 B2
(45) Date of Patent: Apr. 11, 2006

(54) LANYARD ATTACHING MECHANISM

(75) Inventors: Joseph E. Gorrie, Klingerstown, PA (US); Brian E. Probst, Renovo, PA (US)

(73) Assignee: W. T. Storey, Inc., Dalmatia, PA (US)

( * ) Notice: Subject to any disclaimer, the term of this patent is extended or adjusted under 35 U.S.C. 154(b) by 15 days.

(21) Appl. No.: 10/896,557

(22) Filed: Jul. 21, 2004

(65) Prior Publication Data

US 2006/0018114 A1 Jan. 26, 2006

(51) Int. Cl.
*F21L 4/00* (2006.01)

(52) U.S. Cl. ..... 362/208; 362/202

(58) Field of Classification Search ..... 362/208, 362/202, 172, 190–191; 24/3.13, 265 BC, 24/265 EC, 265 H, 265 AL, 130, 129 R
See application file for complete search history.

(56) References Cited

U.S. PATENT DOCUMENTS 6,926,422 B1 * 8/2005 Bruwer et al. ..... 362/157
2004/0246733 A1 * 12/2004 Liaw et al. ..... 362/476

* cited by examiner

*Primary Examiner*—Sandra O'Shea
*Assistant Examiner*—Robert May
(74) *Attorney, Agent, or Firm*—Thomas R. Shaffer, Esq.

(57) ABSTRACT

A flashlight and attached lanyard strap includes a flashlight end having a generally cylindrical wall which has a notch therein. A folded lanyard strap held by a securing pin extends through a bridge opening into a notch chamber and extends outwardly away from the flashlight end through the notch. The arrangement allows the flashlight to be placed on a horizontal surface to shine light into the air (or onto a ceiling) and also allows movement of the lanyard without producing audible sound.

20 Claims, 5 Drawing Sheets

LANYARD ATTACHING MECHANISM

BACKGROUND OF THE INVENTION

1. Field of the Invention

The present invention relates to a lanyard attaching mechanism. More specifically, it relates to a flashlight (or other cylindrical object) having an end cap adapted to receive a lanyard in a manner which allows the flashlight to be "candled" and which is silent when the lanyard is moved relative to the flashlight.

2. Description of the Prior Art

A lanyard is typically described as a cord worn around the neck to hold an object such as a knife or whistle. In the context of the present invention a lanyard is attached to a flashlight. As used in this application, the term "flashlight" is broadly defined as any object which traditionally would be regarded as a flashlight as well as all objects which may be desired to be worn around the neck which have a generally cylindrical end cap portion to which the lanyard may be attached.

Lanyards are typically tied or clipped with a suitable clip member onto an opening formed in an end of an object or to a metal loop provided through such an opening. Lanyards have been around for many years and are extremely effective for holding objects around the neck of the user.

One significant problem with many existing lanyards is that the attaching loop on the object or the knot or fold of the lanyard itself prevents the object from being supported in a lanyard end down position on a floor or flat surface. Emergency workers, fire fighters, police, military and others sometimes have a need to place a flashlight butt end down on the floor or flat surface with the reflector and beam pointing upwardly towards the ceiling or sky. This type of usage of a flashlight is called "candling" and is useful to generally illuminate an entire room or to signal a location to a plane or observer above. There is a need for a lanyard which may be attached to the butt end of a flashlight which allows for such "candling" to take place without the lanyard attaching mechanism or knot interfering with the standing of the flashlight on its butt end.

Another significant problem with many existing lanyard attachment mechanisms it that they utilize one or more metal rings as a part of the attachment mechanism which can clang, clatter, jingle or otherwise cause unwanted noise to occur if the lanyard is moved relative to the flashlight. Such noise can be highly undesirable for military personnel or police officers who wish to keep their presence and location secret. Others, such a nature watchers or persons making any type of audio recordings, may likewise desire to avoid making noise and to remain as silent as is possible. Thus, there is also a need for a silent lanyard attachment mechanism.

SUMMARY OF THE INVENTION

The present invention provides a flashlight and attached lanyard strap which allows for candling and which allows for a silent connection of a lanyard to the butt end of the flashlight. In its simplest form, the present invention provides a flashlight and attached lanyard strap comprising a flashlight end having a generally cylindrical wall with an upper perimeter, said cylindrical wall having a notch therein; an upper wall located at a location below said upper perimeter; a bridge extending from a beginning point to an ending point on opposite sides of said upper perimeter, said bridge having a lower surface spaced above said upper wall and forming a bridge opening, said bridge forming a securing chamber and a notch chamber; and a securing pin positioned in said securing chamber with a folded end of said lanyard strap being securing in said securing chamber by said securing pin, said folded lanyard strap extending through said bridge opening into said notch chamber and extending outwardly away from said flashlight end through said notch.

Preferably, the notch has a notch center point at one location along an upper perimeter of said cylindrical wall, and said notch has a depth at least twice the thickness of the attached lanyard strap. Preferably the notch has a width at least as wide as a width of the lanyard strap.

Preferably, a portion of the cylindrical wall on opposite sides of the notch extends upwardly above said upper wall.

Preferably, said beginning point and said ending point each located 90 degrees from said notch center point.

Preferably, said bridge has an upper surface located coplanar with said upper perimeter:

Preferably, said bridge opening has a height at least the thickness of the attached lanyard strap and has a width at least as great at the lanyard strap.

Preferably, said flashlight end may be placed on its upper perimeter without interference from said lanyard strap allowing the flashlight to be set upon a horizontal surface and freely stand and direct light upwardly.

Preferably, said lanyard is formed of a nylon strap loop but may be formed from a length of a strap, cord or rope made from hemp, cotton, nylon or any other material of sufficient strength to hold the weight of the flashlight.

Preferably, said lanyard does not make audible noise when moved relative to said flashlight.

Preferably, said securing pin is held in place by a frictional engagement with the securing chamber and said securing pin and said lanyard are removable from said flashlight.

DETAILED DESCRIPTION OF THE PREFERRED EMBODIMENTS

Figure 1A:
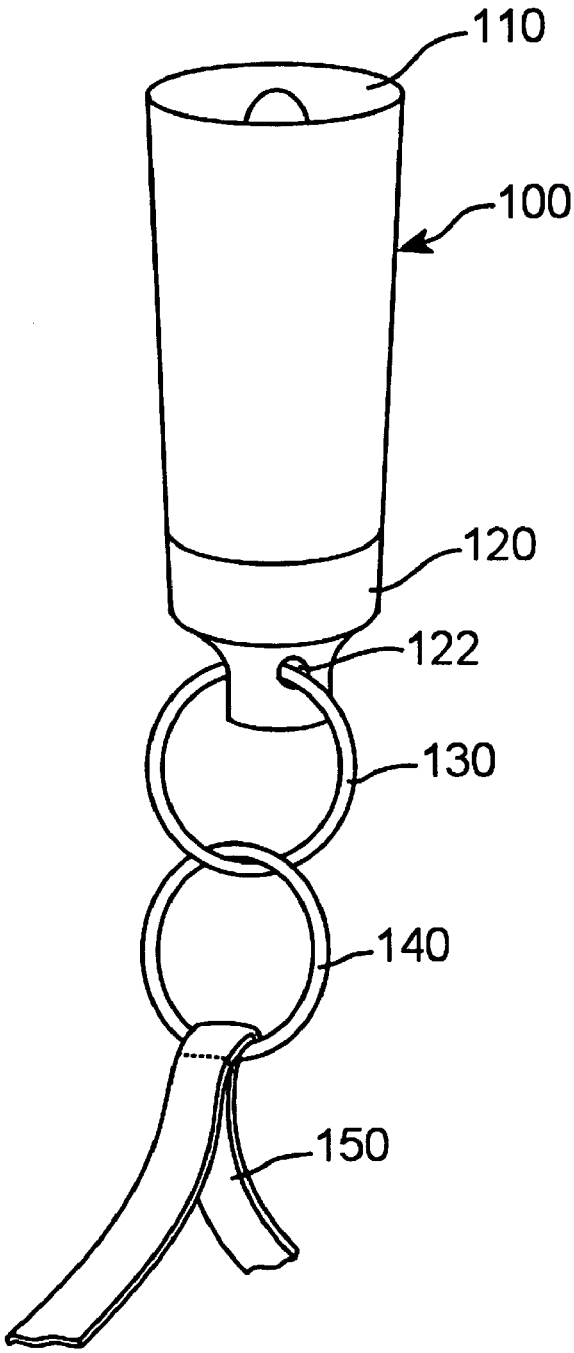
FIG 1A (PRIOR ART)
FIG. 1*a* is a perspective view of a prior art flashlight and attached lanyard.
Figure 1B:
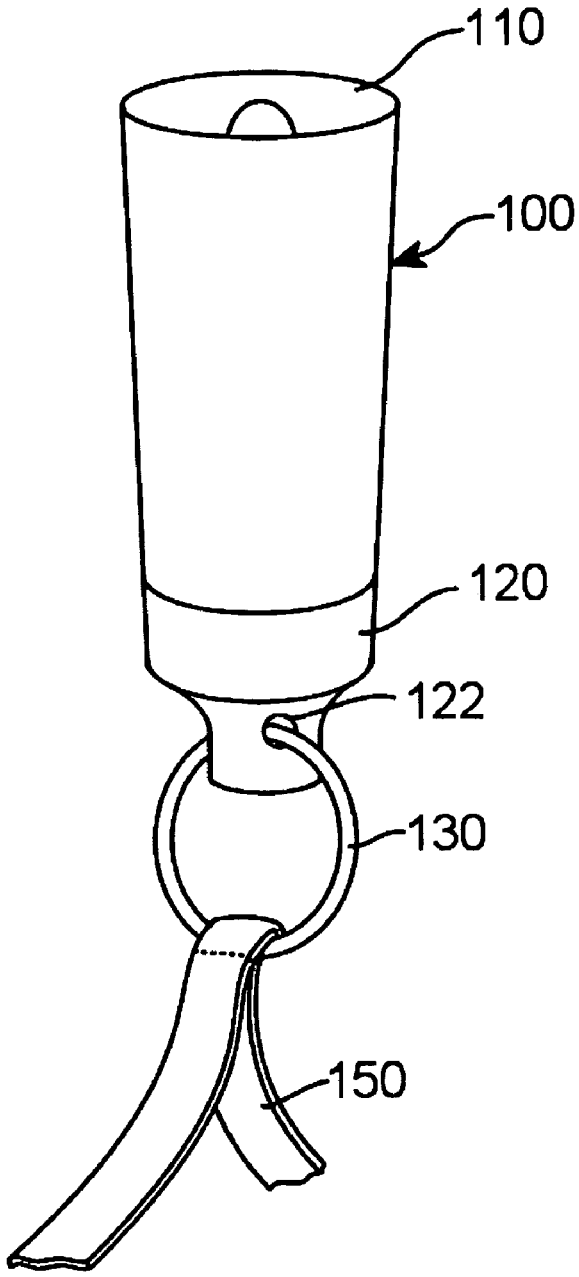
FIG 1B (PRIOR ART)
FIG. 1*b* is a perspective view of a prior art flashlight and attached lanyard.

Referring first to FIG. 1, a prior art flashlight is shown. The flashlight 100 has a bulb end 110 and a butt end 120. The butt end is formed so as to provide an opening 122 into which a split ring 130 is provided. An additional split ring 140 is shown (FIG. 1*a*) as connected to ring 130. Such additional split ring 140 may or may not be utilized. The lanyard as shown as sewn to ring 140. It would be obvious that the lanyard 150 could likewise be attached directly to ring 130 (FIG. 1*b*) rather than ring 140 and may be connected by any suitable knot, clip member or a variety of other attaching means. FIG. 1 illustrates that the butt end 120 of the flashlight is incapable of being placed on a flat surface for candling. FIG. 1 also illustrates that moving the lanyard 150 relative to the flashlight 100 would cause the rings 130 and 140 to make undesired noises.

Figure 2:
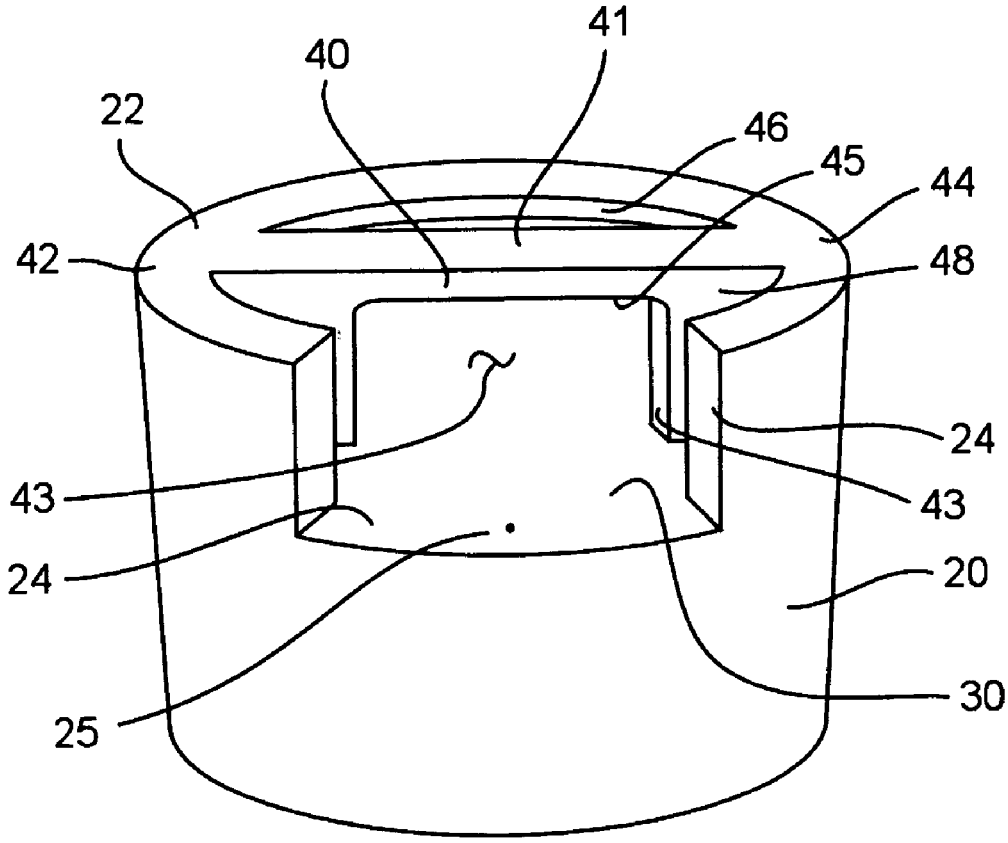
FIG. 2 is a perspective view of a butt end cap of a flashlight including the lanyard attaching mechanism of the present invention.

Referring now to FIG. 2, the butt end 120 of a flashlight of the present invention is shown. End 20 is formed as a cylindrical wall. The cylindrical wall portion 20 has an upper perimeter 22. A notch 24 is formed in the cylindrical wall 20. The notch 24 in the cylindrical wall 20 preferably has a notch center point 25.

An upper wall 30 is provided at the lowest portion of the notch 24.

A bridge 40 extends from a beginning point 42 to an ending point 44 on the upper perimeter 22. The bridge 40 has an upper surface 41 which is coplaner with the upper perimeter 22. The bridge has a lower surface 45 which is spaced above said upper wall 30 and forming a bridge opening 43. As can be best seen in FIGS. 2 and 5, bridge 40 forms a securing chamber 46 and a notch chamber 48.

Figure 4:
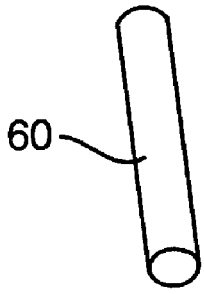
FIG. 4 is a perspective view of a lanyard securing pin.

FIG. 4 shows a securing pin 60 which is adapted to be received in securing chamber 46.

Figure 3:
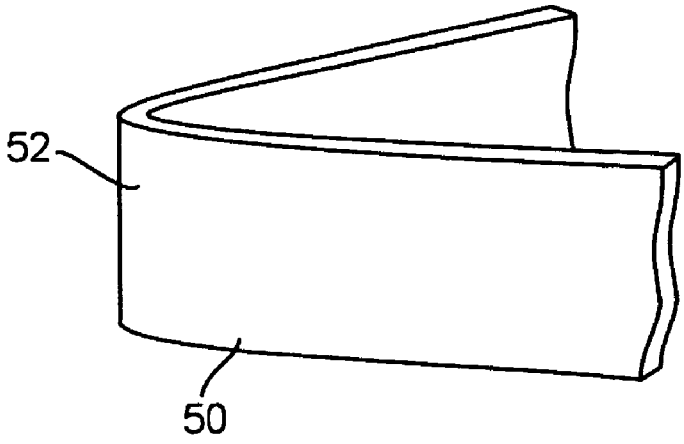
FIG. 3 is a perspective view of a section of a lanyard.

FIG. 3 shows a portion of a lanyard 50 which is folded at location 52.

Figure 5:
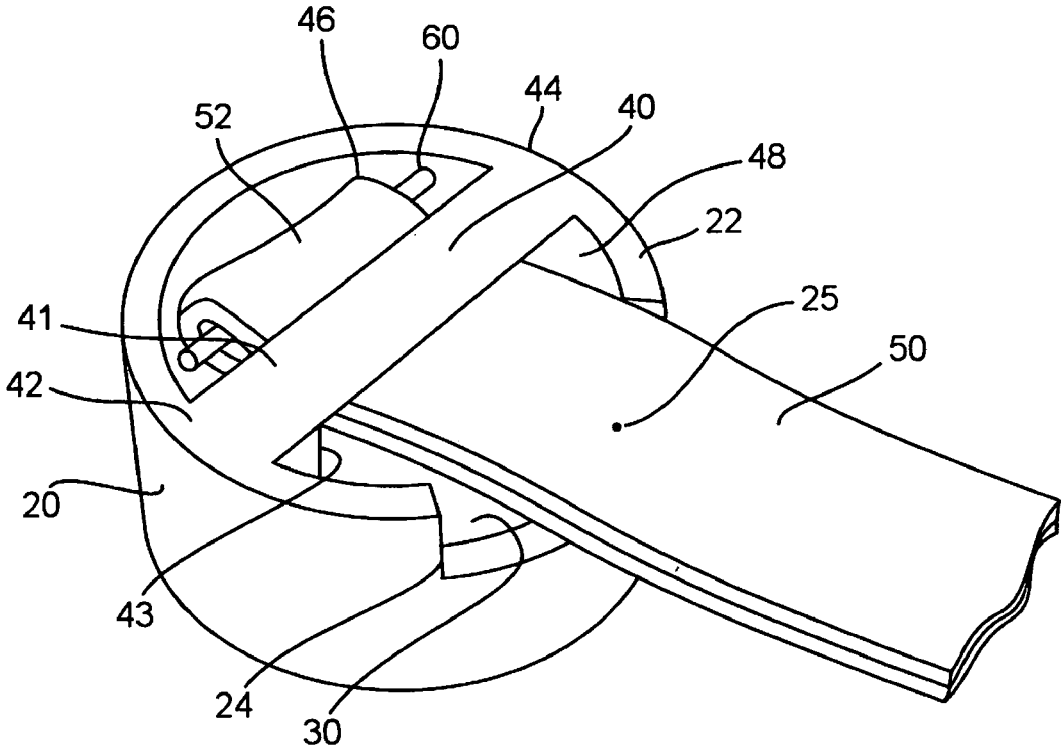
FIG. 5 is a perspective view of an end cap of a flashlight with an attached lanyard.

Referring specifically to FIG. 5, a folded end 52 of lanyard 50 is inserted by sliding the folded end into notch 24 through the bridge opening 43 and is then pulled upward to expose the fold 52. A securing pin 60 is slid into fold 52 and then the fold 52 and attached securing pin are pushed downwardly into securing chamber 46 where it is held by frictional engagement. As shown in both FIGS. 2 and 5, the beginning point 42 and ending point 44 of the bridge are preferably positioned 90 degrees from the notch center point 25.

Figure 6:
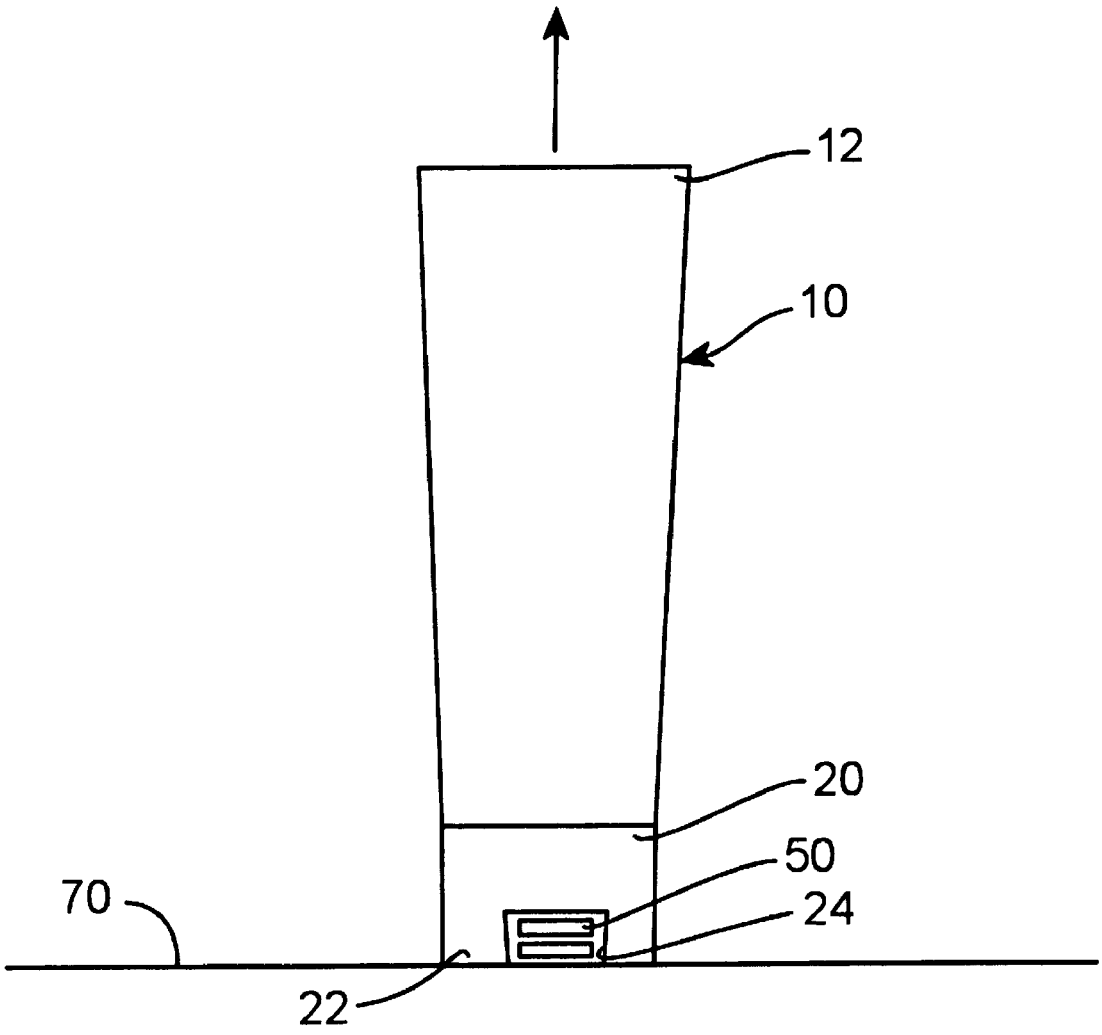
FIG. 6 is a cross-sectional view of a flashlight positioned on a flat surface in a candling position.

Referring to FIG. 6, a flashlight 10 according to the present invention has a beam end 12 and a butt end 20. Notch 24 is shown in the butt end 20 through which the lanyard straps 50 extend. Flashlight 10 is shown resting upon the upper perimeter 22 of the butt end 20 such that the beam end 12 is positioned upwardly in the direction of arrow A towards the ceiling or the sky. The flashlight rests upon flat surface 70.

While it will be obvious to those skilled in the art, if the lanyard of the present invention is intended to be worn around the neck or other body part or attached to clothing, the lanyard strap should be designed as a breakaway strap for safety purposes to prevent accidental injury or death. The presently preferred embodiment as shown as described herein does not include a breakaway lanyard strap and is not intended to be worn around the neck or other body part or attached to clothing. Rather, the lanyard strap 50 of the preferred embodiment is intended to be used only as a carrying strap or a strap to attach the flashlight to an inanimate object.

While we have shown and described the presently preferred embodiment of our invention, the invention is not limited thereto and may be otherwise variously practiced within the scope of the following claims:

We claim:

1. A flashlight and attached lanyard strap comprising:

a) a flashlight end having a generally cylindrical wall with an upper perimeter, said cylindrical wall having a notch therein;

b) an upper wall located at a location below said upper perimeter;

c) a bridge extending from a beginning point to an ending point on opposite sides of said upper perimeter, said bridge having a lower surface spaced above said upper wall and forming a bridge opening, said bridge forming a securing chamber and a notch chamber; and d) a securing pin positioned in said securing chamber with a folded end of said lanyard strap being securing in said securing chamber by said securing pin, said folded lanyard strap extending through said bridge opening into said notch chamber and extending outwardly away from said flashlight end through said notch.

2. A flashlight end and attached lanyard strap according to claim 1 wherein said notch has a notch center point at one location along an upper perimeter of said cylindrical wall, and said notch has a depth at least twice the thickness of the attached lanyard strap.

3. A flashlight end and attached lanyard strap according to claim 1 wherein said notch has a width at least as wide as a width of the lanyard strap.

4. A flashlight end and attached lanyard strap according to claim 1 wherein a portion of the cylindrical wall on opposite sides of the notch extends upwardly above said upper wall.

5. A flashlight end and attached lanyard strap according to claim 1 wherein said beginning point and said ending point each located 90 degrees from said notch center point.

6. A flashlight end and attached lanyard strap according to claim 1 wherein said bridge has an upper surface located coplanar with said upper perimeter.

7. A flashlight end and attached lanyard strap according to claim 1 wherein said bridge opening has a height at least the thickness of the attached lanyard strap.

8. A flashlight end and attached lanyard strap according to claim 1 wherein said bridge opening has a width at least as great at the lanyard strap.

9. A flashlight end and attached lanyard strap according to claim 1 whereby said flashlight end may be placed on its upper perimeter without interference from said lanyard strap allowing a flashlight to be set upon a horizontal surface and freely stand and direct light upwardly.

10. A flashlight end and attached lanyard strap according to claim 1 wherein said lanyard is formed of a nylon strap loop.

11. A flashlight end and attached lanyard strap according to claim 1 whereby said lanyard does not make audible noise when moved relative to said flashlight.

12. A flashlight end and attached lanyard strap according to claim 1 wherein said securing pin is held in place by a frictional engagement with the securing chamber.

13. A flashlight end and attached lanyard strap according to claim 1 wherein said securing pin and said lanyard are removable from said flashlight.

14. A flashlight end and attached lanyard strap according to claim 1 wherein said securing pin and said lanyard are removable from said flashlight.

15. A flashlight end and attached lanyard strap comprising:

a) a flashlight end having a generally cylindrical wall, said cylindrical wall having a notch therein, said notch having a notch center point at one location along an upper perimeter of said cylindrical wall, said notch having a depth at least twice the thickness of the attached lanyard strap and said notch having a width at least as great at the lanyard strap;

b) an upper wall located at or below a lowest point of said notch whereby at least a portion of the cylindrical wall on opposite sides of the notch extends upwardly above said upper wall;

c) a bridge extending from a beginning point to an ending point one opposite sides of said upper perimeter, said beginning point and said ending point each located 90 degrees from said notch center point, said bridge having an upper surface located coplanar with said upper perimeter and having a lower surface, said lower surface spaced above said upper wall and forming a bridge opening, said bridge opening having a height at least the thickness of the attached lanyard strap and having a width at least as great at the lanyard strap, said bridge forming a securing chamber and a notch chamber; and d) a securing pin positioned in said securing chamber with a folded end of said lanyard strap being securing in said securing chamber by said securing pin, said folded lanyard strap extending through said bridge opening into said notch chamber and extending outwardly away from said flashlight end through said notch, whereby said flashlight end may be placed on its upper perimeter without interference from said lanyard strap.

16. A flashlight end and attached lanyard strap according to claim 15 whereby said flashlight end may be placed on its upper perimeter without interference from said lanyard strap allowing said flashlight to be set upon a horizontal surface and freely stand and direct light upwardly.

17. A flashlight end and attached lanyard strap according to claim 15 wherein said lanyard is formed from a rope, cord or strap made from any material of sufficient strength to hold the weight of the flashlight.

18. A flashlight end and attached lanyard strap according to claim 15 whereby said lanyard does not make audible noise when moved relative to said flashlight.

19. A flashlight end and attached lanyard strap according to claim 15 wherein said securing pin is held in place by a frictional engagement with the securing chamber.

20. A flashlight end and attached lanyard strap according to claim 15 wherein said lanyard is formed of a nylon strap loop.

* * * * *